US009512368B2

(12) United States Patent
Gordon

(10) Patent No.: US 9,512,368 B2
(45) Date of Patent: Dec. 6, 2016

(54) METHOD OF PREVENTING CORROSION OF OIL PIPELINES, STORAGE STRUCTURES AND PIPING

(71) Applicant: FIELD UPGRADING LIMITED, Calgary (CA)

(72) Inventor: John Howard Gordon, Salt Lake City, UT (US)

(73) Assignee: FIELD UPGRADING LIMITED, Calgary, Alberta (CA)

( * ) Notice: Subject to any disclaimer, the term of this patent is extended or adjusted under 35 U.S.C. 154(b) by 242 days.

(21) Appl. No.: 13/770,610

(22) Filed: Feb. 19, 2013

(65) Prior Publication Data

US 2013/0153469 A1 Jun. 20, 2013

Related U.S. Application Data

(63) Continuation-in-part of application No. 13/679,696, filed on Nov. 16, 2012, now Pat. No. 9,441,170, which is a continuation-in-part of application No. 12/916,984, filed on Nov. 1, 2010, now Pat. No. 8,828,220.

(60) Provisional application No. 61/560,653, filed on Nov. 16, 2011, provisional application No. 61/257,369, filed on Nov. 2, 2009.

(51) Int. Cl.
*C10G 29/04* (2006.01)
*C10G 75/02* (2006.01)

(52) U.S. Cl.
CPC ..... *C10G 29/04* (2013.01); *C10G 75/02* (2013.01); *C10G 2300/203* (2013.01)

(58) Field of Classification Search
CPC .... C10G 2300/203; C10G 29/04; C10G 75/02
See application file for complete search history.

(56) References Cited

U.S. PATENT DOCUMENTS

| | | | |
|---|---|---|---|
| 1,501,756 | A | 7/1924 | Downs |
| 2,055,210 | A | 9/1936 | Vose |
| 2,249,340 | A | 7/1941 | Wilson |
| 2,772,211 | A | 11/1956 | Hawkes et al. |

(Continued)

FOREIGN PATENT DOCUMENTS

| | | |
|---|---|---|
| CA | 2531262 A1 | 6/2007 |
| DE | 2558505 | 11/1976 |

(Continued)

OTHER PUBLICATIONS

Seifert, Fortschritte der Chemie Organischer Naturstoffe, 1975, vol. 32, Springer-Verlang/Wein, pp. 1-44.*

(Continued)

*Primary Examiner* — In Suk Bullock
*Assistant Examiner* — Derek Mueller
(74) *Attorney, Agent, or Firm* — Foley & Lardner LLP

(57) ABSTRACT

Corrosion of ferrous material such as steel or stainless steel is a problem in oil pipelines, oil storage tanks, and the piping and process equipment at oil refineries, and this corrosion may be reduced by reducing the TAN value of the oil feedstock that is used/transported within the ferrous material. This TAN value may be reduced by reacting the oil feedstock with an alkali metal, thereby forming a de-acidified alkali metal. The de-acidified alkali metal has a TAN value of less than or equal to 1 mgKOH/g.

8 Claims, 5 Drawing Sheets

(56) References Cited

U.S. PATENT DOCUMENTS

| | | | | |
|---|---|---|---|---|
| 2,836,633 | A | | 5/1958 | Esmay |
| 3,164,545 | A | | 1/1965 | Mattox |
| 3,497,569 | A | | 2/1970 | Stiles et al. |
| 3,785,965 | A | | 1/1974 | Welty |
| 3,787,315 | A | | 1/1974 | Bearden, Jr. et al. |
| 3,788,978 | A | | 1/1974 | Bearden, Jr. et al. |
| 3,791,966 | A | | 2/1974 | Bearden |
| 3,960,708 | A | | 6/1976 | McCollum et al. |
| 4,076,613 | A | | 2/1978 | Bearden, Jr. |
| 4,428,828 | A | | 1/1984 | Bose |
| 4,454,017 | A | | 6/1984 | Swanson |
| 4,500,414 | A | | 2/1985 | Audeh |
| 4,501,652 | A | | 2/1985 | Le et al. |
| 4,606,812 | A | | 8/1986 | Swanson |
| 5,328,577 | A | | 7/1994 | Murphy |
| 5,695,632 | A | | 12/1997 | Brons et al. |
| 5,750,814 | A | | 5/1998 | Grootjans et al. |
| 5,935,419 | A | | 8/1999 | Khan et al. |
| 5,935,421 | A | | 8/1999 | Brons et al. |
| 6,022,494 | A | * | 2/2000 | Sartori et al. ..... 252/387 |
| 6,132,590 | A | | 10/2000 | Moran et al. |
| 6,210,564 | B1 | | 4/2001 | Brons et al. |
| 6,280,128 | B1 | | 8/2001 | Schrader |
| 6,368,486 | B1 | | 4/2002 | Thompson et al. |
| 6,413,898 | B1 | | 7/2002 | Faber et al. |
| 6,635,795 | B2 | | 10/2003 | Gislason et al. |
| 6,697,987 | B2 | | 2/2004 | Lee et al. |
| 6,706,902 | B2 | | 3/2004 | Sturmann et al. |
| 6,734,133 | B1 | | 5/2004 | Weisbeck et al. |
| 6,787,019 | B2 | | 9/2004 | Jacobson et al. |
| 7,504,023 | B2 | | 3/2009 | Chamberlain Pravia et al. |
| 7,897,028 | B2 | | 3/2011 | Gordon et al. |
| 8,088,270 | B2 | | 1/2012 | Gordon et al. |
| 8,828,220 | B2 | | 9/2014 | Gordon |
| 2002/0011430 | A1 | | 1/2002 | Greaney |
| 2002/0125175 | A1 | | 9/2002 | Collins et al. |
| 2005/0145545 | A1 | | 7/2005 | Schucker |
| 2005/0161340 | A1 | | 7/2005 | Gordon et al. |
| 2006/0054538 | A1 | | 3/2006 | Hsu et al. |
| 2006/0138029 | A1 | | 6/2006 | Malek et al. |
| 2007/0087934 | A1 | | 4/2007 | Martens et al. |
| 2008/0031792 | A1 | | 2/2008 | Ciccarelli et al. |
| 2008/0251422 | A1 | | 10/2008 | Baez et al. |
| 2009/0134040 | A1 | | 5/2009 | Gordon et al. |
| 2009/0134059 | A1 | | 5/2009 | Myers et al. |
| 2009/0259082 | A1 | | 10/2009 | Deluga et al. |
| 2010/0089762 | A1 | | 4/2010 | Gordon |
| 2010/0155298 | A1 | | 6/2010 | Raterman et al. |
| 2010/0187124 | A1 | | 7/2010 | Koveal |
| 2010/0276335 | A1 | | 11/2010 | Schucker |
| 2010/0297531 | A1 | | 11/2010 | Liu et al. |
| 2010/0297537 | A1 | | 11/2010 | Coors et al. |
| 2010/0304953 | A1 | | 12/2010 | Liu et al. |
| 2011/0054232 | A1 | | 3/2011 | Sangar et al. |
| 2011/0100874 | A1 | | 5/2011 | Gordon |
| 2011/0119994 | A1 | | 5/2011 | Hogendoorn et al. |
| 2011/0155647 | A1 | | 6/2011 | Serban et al. |
| 2012/0304530 | A1 | | 12/2012 | Chitta et al. |
| 2013/0043160 | A1 | | 2/2013 | Gordon |
| 2013/0140217 | A1 | | 6/2013 | Gordon et al. |
| 2013/0153469 | A1 | | 6/2013 | Gordon |

FOREIGN PATENT DOCUMENTS

| | | | |
|---|---|---|---|
| KR | 2006-0032194 | | 4/2006 |
| WO | WO-97/08270 | | 3/1997 |
| WO | WO-02099013 | | 12/2002 |
| WO | WO-2005/066302 | | 7/2005 |
| WO | WO2010016899 | | 1/2010 |
| WO | WO-2010124030 | | 10/2010 |
| WO | WO-2011012900 | | 2/2011 |
| WO | WO-2011/053919 | A2 | 5/2011 |
| WO | WO2011053919 | | 9/2011 |
| WO | WO2013019596 | | 2/2013 |
| WO | WO20122147097 | | 3/2013 |

OTHER PUBLICATIONS

Reggel, et al., "Desulphurization of Gasoline by Metallic Sodium", *Fuel*, vol. 55, (Jul. 1976),170-172.

Byun, Sang H., "International Search Report", International Search Report for PCT US 2010/054984 (Corresponding to U.S. Appl. No. 12/916,984 (Jul. 28, 2011),1-3.

Byun, Sang H., "Written Opinion of the International Searching Authority", Written Opinion for PCT US 2010/054984 (Corresponding to U.S. Appl. No. 12/916,984 (Jul. 28, 2011),1-5.

Kabe, T. et al., "Hydrodesulfurization and Hydrodenitrogenation", *Wiley-VCH* (1999), (1999),110-112.

Task Force on Strat. Uncnv. Fuel, "America's Strategic Unconventional Fuels, vol. III Resource and Technology Profiles", *America's Strategic Unconventional Fuels, vol. III Resource and Technology Profiles* (completed Feb. 2007, Published Sep. 2007)., Full text available at http://www.unconventionalfuels.org/publications/reports/Volume_III_ResourceTechProfiles(Final).pdf,(Sep. 2007),III-25.

Lee, Young W., "International Search Report", PCT/US/2012/039388 (corresponding to U.S. Appl. No. 12/916,948), (Dec. 27, 2012),1-3.

Lee, Young W., "Written Opinion of the International Searching Authority", PCT/US/2012/039388 (corresponding to U.S. Appl. No. 12/916,948), (Dec. 27, 2012),1-3.

Yu, Jianfei et al., "High temperature naphthenic acid corrosion of steel in high TAN refining media", *Anti-Corrosion Methods and Materials*, vol. 55 Issue 5, (2008),257-63.

Wang, Chen et al., "High Temperature Naphthenic Acid Corrosion of Typical Steels", *Canadian Journal on Mechanical Sciences and Engineering* vol. 2, No. 2 (Feb. 1, 2011),23-30.

Seo, Sang Y., "International Search Report", PCT App. No. PCT/US2012/046939 (Corresponding to U.S. Appl. No. 13/550,313), (Jan. 31, 2013),1-3.

Seo, Sang Y., "Written Opinion of the International Searching Authority", PCT App. No. PCT/US2012/046939 (Corresponding to U.S. Appl. No. 13/550,313), (Jan. 31, 2013),1-6.

Valencia, Juan C., "Notice of Allowance", U.S. Appl. No. 13/753,918, (Nov. 20, 2013),1-18.

"Non Final Office Action", Chinese Application No. 201080049770.5 (Dec. 4, 2013),1-18.

"Non Final Office Action", Chinese Application No. 201080049770.5, (Dec. 4, 2013),1-18.

"Natural Gas", http://www.gasenergia.com.br/portal/ing/gasnatural/dadostecnicos.jsp, (Jun. 10, 2004),1-20.

Sternberg, et al., "Solubilization of Coal via Reductive Alkylation", *Preprints of Papers—American Chemical Society, Division of Fuel Chemistry* (1970), 14(1), 87-94 (available to the public 1984) Coden: ACFPAI, ISSN: 0569-3772, (1970),87-94.

Valencia, Juan C., "Non-Final Office Action", U.S. Appl. No. 12/916,984, (Sep. 10, 2013),1-10.

Valencia, Juan C., "Non Final Office Action", U.S. Appl. No. 13/550,313, (Sep. 10, 2013),1-12.

Lee, Dong W., "International Search Report", PCT Application No. PCT/US1350194 (Corresponding to U.S. Appl. No. 13/940,336), (Nov. 5, 2013),1-5.

Lee, Dong W., "Written Opinion of the International Searching Authority", PCT Application No. PCT/US1350194 (Corresponding to U.S. Appl. No. 13/940,336), (Nov. 5, 2013),1-5.

Lee, Dong W., "International Search Report", PCT Application No. PCT/US2013/026698 (Corresponding to U.S. Appl. No. 13/770,610), (Aug. 19, 2013),1-5.

Lee, Dong W., "Written Opinion of the International Searching Authority", PCT Application No. PCT/US2013/026698 (Corresponding to U.S. Appl. No. 13/770,610), (Aug. 19, 2013),1-5.

Lee, Dong W., "International Search Report", PCT/US2013/023850 (Corresponding to U.S. Appl. No. 13/753,918), (May 14, 2013),1-3.

Lee, Dong W., "Written Opinion of the International Searching Authority", PCT/US2013/023850 (Corresponding to U.S. Appl. No. 13/753918), (May 14, 2013),1-5.

Wood, Elizabeth D., "Non-Final Office Action", U.S. Appl. No. 13/049,7057, (Jul. 15, 2013),1-7.

(56) References Cited

OTHER PUBLICATIONS

Hwang, Yun K., "International Search Report", PCT App. No. PCT/US2012/065670 (corresponding to U.S. Appl. No. 13/679,696), (Apr. 1, 2013),1-4.
Hwang, Yun K., "Written Opinion of the International Searching Authority", PCT App. No. PCT/US2012/065670 (corresponding to U.S. Appl. No. 13/679,696), (Apr. 1, 2013),1-8.
Valencia, Juan C., "Non-Final Office Action", U.S. Appl. No. 12/916,984, (Mar. 25, 2013),1-10.
Sternberg, et al., "On the Solubilization of Coal Via Reductive Alkylation", *Preprints of Papers—American Chemical Society, Division of Fuel Chemistry* (1970), 14(1), (available to the public 1984), (1984),87-94.
Bentor, Yinon "Chemical Element.com—Sodium", http://www.chemicalelement.com/elements/na.html, (1996),1-3.
Non-Final Office Action on U.S. Appl. No. 13/679,696, mailed Jul. 14, 2015.
Examiner's Report dated Dec. 18, 2015 for CA Appl 2769863. 4 pages.
Extended European Search Report dated Dec. 7, 2015 on EP 10827610.6 (8 pages).
US Office Action dated Dec. 3, 2015, 16 pages.
Valencia, Juan C., "Notice of Allowance", U.S. Appl. No. 12/916,984, (May 7, 2014),1-9.
Valencia, Juan C., "Notice of Allowance", U.S. Appl. No. 13/550,313, (May 8, 2014),1-8.
Oh, Eung G., "International Search Report", PCT Application No. PCT/US2014/034183 (Corresponding to U.S. Appl. No. 14/253,286), (Aug. 11, 2014),1-3.
Oh, Eung G., "Written Opinion of the International Searching Authority", PCT Application No. PCT/US2014/034183 (Corresponding to U.S. Appl. No. 14/253,286), (Aug. 11, 2014),1-6.
Lee, Chang H., "International Search Report", PCT Application No. PCT/US2014/027292 (Corresponding to U.S. Appl. No. 14/210,891), (Jul. 8, 2014),1-3.
Lee, Chang H., "Written Opinion of the International Search Authority", PCT Application No. PCT/US2014/027292 (Corresponding to U.S. Appl. No. 14/210,891), (Jul. 8, 2014),1-5.
Aizawa, Keisuke "Non-Final Office Action", Japanese Application No. 2012537170, (Aug. 26, 2014),1-6.
Lachman, Richard "Supplementary European Search Report", (Nov. 11, 2014),1-7.
"Non Final Office Action", Chinese Application No. 201080049770.5, (Jul. 1, 2014),1-4.
"Notice on Grant of Patent Right for Invention", Chinese Patent Application No. 201080049770.5, (Oct. 10, 2014),1-4.
Bearden, "Bibliographic Data", German Patent Publication DE2558505, (Nov. 18, 1976),1.
Francis, Humblot "Bibliographic data and English Abstract", Korean Patent Publication KR20060032194, (Apr. 14, 2006),1.
Examination Report for SG Application No. 11201402307S, dated Dec. 1, 2015, 11 pages.
Extended European Search Report dated May 30, 2016, in related application EP 13855801.0.
Extended European Search Report for EP Application No. 128498383.3, mail date Jun. 12, 2015, 10 pages.
Notice of Reason for Rejection with English Translation for JP Application No. 2014-542519, mail date Mar. 22, 2016, 9 pages.
Search Report and Written Opinion for SG Application No. 11201402307S, mail date Apr. 24, 2015, 19 pages.
US Notice of Allowance on U.S. Appl. No. 13/679696 DTD May 9, 2016.

* cited by examiner

METHOD OF PREVENTING CORROSION OF OIL PIPELINES, STORAGE STRUCTURES AND PIPING

RELATED APPLICATIONS

This application is a continuation-in-part of U.S. patent application Ser. No. 12/916,984, filed Nov. 1, 2010, entitled "UPGRADING OF PETROLEUM OIL FEEDSTOCKS USING ALKALI METALS AND HYDROCARBONS", which application claims the benefit of U.S. Provisional Patent Application Ser. No. 61/257,369 filed Nov. 2, 2009, entitled "UPGRADING OF PETROLEUM OIL FEEDSTOCKS USING ALKALI METALS AND HYDROCARBONS". This application is also a continuation-in-part of U.S. patent application Ser. No. 13/679,696 filed on Nov. 16, 2012, which application claims the benefit of U.S. Provisional Patent Application Ser. No. 61/560,563 filed Nov. 16, 2011. All of these prior patent applications are expressly incorporated herein by reference.

TECHNICAL FIELD

The present invention relates to a method of preventing piping, such as steel piping, from corroding. More particularly, the invention relates to a method of preventing steel pipes and steel equipment used to transport and/or process shale oil, bitumen, heavy oil materials or oil refinery streams from corroding.

BACKGROUND

U.S. patent application Ser. No. 12/916,984 (which has been incorporated herein by reference) has been published as United States Patent Application Publication No. 2011/0100874. The reader is presumed to be familiar with the disclosure of this published application. This published application will be referred to herein as the "'874 application."

The demand for energy (and the hydrocarbons from which that energy is derived) is continually rising. However, hydrocarbon raw materials used to provide this energy often contain difficult-to-remove sulfur and metals. For example, sulfur can cause air pollution and can poison catalysts designed to remove hydrocarbons and nitrogen oxide from motor vehicle exhaust, necessitating the need for expensive processes used to remove the sulfur from the hydrocarbon raw materials before it is allowed to be used as a fuel. Further, metals (such as heavy metals) are often found in the hydrocarbon raw materials. These heavy metals can poison catalysts that are typically utilized to remove the sulfur from hydrocarbons. To remove these metals, further processing of the hydrocarbons is required, thereby further increasing expenses.

Currently, there is an on-going search for new energy sources in order to reduce the United States' dependence on foreign oil. It has been hypothesized that extensive reserves of shale oil, which constitutes oil retorted from oil shale minerals, will play an increasingly significant role in meeting this country's future energy needs. In the U.S., over 1 trillion barrels of usable, reserve shale oil are found in a relatively small area known as the Green River Formation located in Colorado, Utah, and Wyoming. As the price of crude oil rises, these shale oil resources become more attractive as an alternative energy source. In order to utilize this resource, specific technical issues must be solved in order to allow such shale oil reserves to be used, in a cost effective manner, as hydrocarbon fuel. One issue associated with these materials is that they contain a relatively high level of nitrogen, sulfur and metals, which must be removed in order to allow this shale oil to function properly as a hydrocarbon fuel.

Other examples of potential hydrocarbon fuels that likewise require a removal of sulfur, nitrogen, or heavy metals are bitumen (which exists in ample quantities in Alberta, Canada) and heavy oils (such as are found in Venezuela).

The high level of nitrogen, sulfur, and heavy metals in shale oil, bitumen and heavy oil (which may collectively or individually be referred to as "oil feedstock") makes processing these materials difficult. Typically, these oil feedstock materials are refined to remove the sulfur, nitrogen and heavy metals through a process known as "hydro-treating." The hydro-treating process, as well as the potential problems of the hydro-treating process, are described in the '874 application.

Additionally, naphthenic acids must be removed from many organic streams that are produced by refineries. Naphthenic acids ("NAPs") are carboxylic acids present in petroleum crude or various refinery streams. These acids are responsible for corrosion in refineries. A common measure of acidity of petroleum is called the Total Acid Number ("TAN") value and is defined as the milligrams (mg) of potassium hydroxide needed to neutralize the acid in one gram of the petroleum material. (Other acids found in the oil feedstock may also contribute to the TAN value). All petroleum streams with TAN >1 are called high TAN. NAPs are a mixture of many different compounds and cannot be separated via distillation. Moreover high TAN crudes are discounted over Brent Crude prices. For example, Doba crude with a TAN of 4.7 is discounted by $19 per barrel on a base price of $80 for Brent crude.

NAPs boil in the same range as that of kerosene/jet fuel. (However, kerosene/jet fuels have very stringent TAN specifications.) Attempting to neutralize these acids using aqueous caustic or other bases form salts. These salts in presence of water, lead to formation of stable emulsions. Additional methodologies of NAP reduction include hydrotreating or decarboxylation that are both destructive methodologies and the NAPs cannot be recovered using these methods. Solvent extraction or adsorption methodologies lead to high costs and energy usage for sorbent regeneration or solvent boiling.

NAPs in the oil feedstock can also cause corrosion of the pipes that are used to transport the oil feedstock. Accordingly, a method for preventing the corrosion of pipes that are used to process/transport oil materials that have high NAP values is needed.

Corrosion of ferrous material such as steel or stainless steel is a problem in oil pipelines, oil storage tanks, and the piping and process equipment at oil refineries, especially if such piping is used with materials that have a high TAN value. Oil refinery operators often limit how much feed is allowed into the refinery that has a high TAN number because they know that their ferrous piping and process equipment will corrode more readily if the TAN number is too high. As a result, the price paid for petroleum feedstocks with higher TAN will be lower than the price paid for feedstocks with lower TAN. For the purposes of this document, the term "stainless steel" refers to ferrous material other than mild steel.

SUMMARY

The '874 application describes a process where an alkali metal is used to reduce the sulfur, nitrogen and metals content of petroleum feedstocks. While sulfur, nitrogen, and metals content are reduced, for example where the metals are nickel, vanadium, and iron among others, experimentally, the TAN also is found to drop from whatever starting point to a value of "0 mgKOH/g". For the purposes of this invention a "petroleum feedstock" or an "oil feedstock" includes, bitumen, petroleum, heavy oil, shale oil, oil shale, diesel, coker diesel, naptha, and other hydrocarbon liquids and semi-liquids, and hydrocarbon gases and mixtures thereof.

For example, three different feedstocks of bitumen from Cold Lake in Alberta, Canada, had a starting TAN of 2.3 mgKOH/g, another bitumen sample from McKay River in Alberta, Canada, had a starting TAN of 5.2 mgKOH/g, and a heavy oil crude sample from California had a starting TAN of 4.2 mgKOH/g. Each of these feedstocks, after treatment with the process described in the '874 application (using either hydrogen gas or methane as part of the reaction), had a resulting TAN value of "0 mgKOH/g". These experimental results can be explained by the fact that sodium is known to reduce protons to hydrogen gas. Thus, any acids in the petroleum feedstocks (whether in mineral or organic form) will react to form the sodium salt and hydrogen—as shown in the following equations:

$$R^-H^+ + Na \rightarrow R^-Na^+ + \tfrac{1}{2}H_2$$

where R represents an organic anion such as naphthenic anion $$R^-H^+ + M \rightarrow R^-M^+ + \tfrac{1}{2}H_2$$

where R represents an organic anion such as naphthenic anion and M represents an alkali metal Likewise, the same reaction would occur if lithium metal were used instead of metallic sodium.

The following articles indicate that oil feedstock materials having high TAN values may have an adverse effect on the corrosion of steel and stainless steel (which may be used in the construction pipelines, storage vessels, process equipment, pumps and piping used to process/refine the feedstock:

Jianfei Yu; L Jiang; Fuxing Gan, "High temperature naphthenic acid corrosion of steel in high TAN refining media", Anti-Corrosion Methods and Materials, Vol. 55 Issue 5, pp, 257-263;

Chen Wang, Yinpei Wang, Jin Chen, Xiaoming Sun, Zengdian liu, Qian Wan, Yanxia Dai, Wenbing Zheng, "HIGH TEMPERATURE NAPHTHENIC ACID CORROSION OF TYPICAL STEEIS", Canadian Journal on Mechanical Sciences and Engineering Vol. 2, No, 2, February 2011.

(The foregoing articles are expressly incorporated herein by reference.) Accordingly, processing the oil feedstock with an alkali metal (and either hydrogen or hydrocarbon gases) will reduce corrosion rates of the stainless steel used in the oil pipelines, reaction vessels, pipes, etc. because the TAN value of the oil feedstock has been reduced. For example, if the TAN is reduced to less than "1 mgKOH/g", then the corrosion rate of the steel in the pipes becomes drastically reduced and becomes negligible as the TAN value approaches 0 mgKOH/g.

In addition, corrosion can be further prevented by introducing excess alkali metal into the oil such that after reaction with organic sulfur, organic nitrogen, organic metals, and naphthenic acids, there is still a quantity of free metallic sodium droplets in the oil feedstock. These droplets or particulates present in the oil feedstock serve as anodes and provide cathodic protection where the alkali metal oxidizes preferentially to the ferrous metal. This phenomenon is due to the relative electrochemical potentials of alkali metals relative to ferrous substances. For example, the reduction potential for iron is −0.447V but the reduction potential for lithium is −3.04V and for sodium it is −2.71 V. Thus as long as there is free metallic alkali metal flowing with the oil feedstock or residing in a storage structure, the alkali metal will oxidize before the ferrous material.

DETAILED DESCRIPTION

Figure 1:
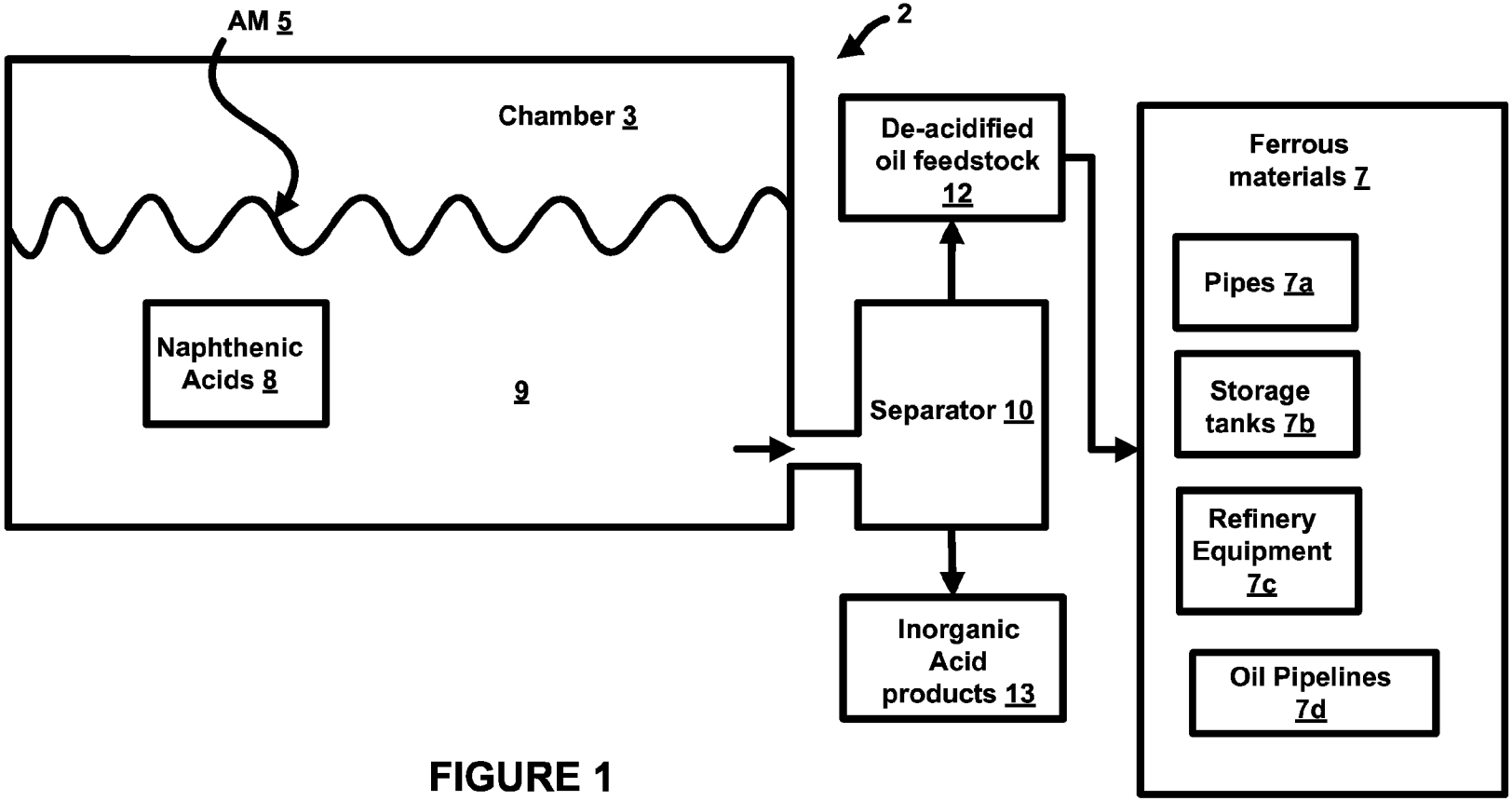
FIG. 1 shows a schematic drawing of a device that may be used to de-acidify a quantity of an oil feedstock.

The present embodiments relate to a method to de-acidify petroleum feedstocks (which are sometimes called "oil feedstocks") and refinery streams. Such de-acidification is beneficial as it may operate to reduce piping corrosion and may convert naphthenic acids to a salt form. The present embodiments involve the addition of alkali metals (such as sodium, potassium, lithium or alloys thereof) to the feedstocks as a means of reacting with the naphthenic acids, thereby de-acidifying these acids. When this reaction occurs, the naphthenic acids may be converted into the corresponding sodium or lithium salts (or other inorganic products). Hydrogen gas is also formed in this reaction. This reaction is summarized as follows:

$$R{-}COOH + Na \rightarrow (R{-}COO^-)Na^+ + \tfrac{1}{2}H_2$$

The reaction with NAPs in this manner may be desirable and may result in a reduction of Total Acid Number ("TAN") associated with the oil feedstock. For example, the oil feedstock may have a TAN value (measured in mgKOH/g) of over 1 (such as, for example, 3, 4, 5, etc.). However, after reaction with the alkali metal, the TAN value is significantly decreased, such as for example, to a value of less than or equal to 1 mgKOH/g.

There are multiple different ways in which the alkali metal may be added to the feedstock. In one embodiment, the sodium or lithium metal is directly added to the stream. Once this occurs, the inorganic products may then be filtered from the oil stream. Other embodiments may also be designed (as described herein) to provide other mechanisms for adding the alkali metal to the stream of oil feedstock (such as, for example, by forming the alkali metal in situ).

It should be noted that, in addition to reacting with the acids (such as naphthenic acids), the alkali metals that are added to the feedstock may also react to remove sulfur, nitrogen (e.g., heteroatoms) as well as metals (such as heavy metals) from the oil feedstock. This process for removing these metals/heteroatoms is discussed in the '874 application. Thus, by adding alkali metals to the oil feedstock, the problems associated with metals/heteroatoms in the stream, as well as problems with acids in the stream, may be overcome.

It should be noted that many in the oil processing industry are uncomfortable handling metallic sodium or lithium because of its reactive nature. In other words, these practitioners are uncomfortable using sodium/lithium and are uncomfortable adding these reagents directly to their oil feedstock streams. Accordingly, the present embodiments also provide methods and devices which operate to electrochemically produce alkali metals within an oil feedstock chamber (e.g., in situ), thereby bringing an alkali metal such as sodium in direct contact with the feedstock. Once this alkali metal is produced in the chamber, it is consumed by reacting with the heavy metals/heteroatoms and/or the acids in the feedstock. These embodiments may be desirable in that they provide the strong reducing power and reactivity associated with alkali metals without ever having an appreciable amount of the metal present. In other words, the present embodiments de-acidify an oil feedstock using the alkali metal (e.g., a strong agent) without the practitioner being required to handle, store, or transport the alkali metal.

Referring now to FIG. 1, a device 2 is illustrated that may be used to de-acidify a quantity of a first oil feedstock 9. As shown in FIG. 1, the oil feedstock 9 is a liquid that is placed within a chamber 3. The chamber 3 may be a reaction vessel, a chamber of an electrolysis cell (as will be described herein), etc. Those skilled in the art will appreciate what vessels, containers, etc., may be used as the chamber 3.

The oil feedstock 9 comprises a quantity of naphthenic acids 8. As described above, naphthenic acids 8 comprise carboxylic acids present in petroleum crude or various refinery streams. Naphthenic acids 8 are a mixture of many different compounds and cannot be separated out via distillation. In order to eliminate the naphthenic acids 8 from the oil feedstock 9, a quantity of an alkali metal 5 is added to the chamber 3. (The alkali metal is abbreviated as "AM.") In some embodiments, the alkali metal may be sodium, lithium or alloys of sodium and lithium. The chamber 3 may be kept at a temperature that is above the melting point of the alkali metal 5 such that the liquid alkali metal 5 may easily be added to the liquid oil feedstock. In some embodiments, the reaction occurs at a temperature that is above the melting point of the alkali metal (or above a temperature of about 100° C.). In other embodiments, the temperature of the reaction is less than about 450° C.

When added to the chamber 3, the alkali metal 5 may react with the oil feedstock 9. More specifically, the alkali metal 5 reacts with the quantity of the naphthenic acids 8 to form a de-acidified feedstock 12. As inorganic acid products 13 may also be formed from this reaction, a separator 10 may be used to separate the de-acidified oil feedstock 12 from the inorganic acid products 13. Those skilled in the art will appreciate how this separation may occur. Moreover, those skilled in the art will appreciate the structures (such as a settling chamber, etc.) that may be used as the separator 10. The separator 10 may be integral with the chamber 3 or may be a separate structure, as shown in FIG. 1.

As explained herein, the reaction between the alkali metal 5 and the naphthenic acids 8 operates to eliminate the naphthenic acids 8 from the oil feedstock 9. Thus, the TAN value of the de-acidified oil feedstock 12 will be lower than the TAN value of the original (unreacted) first oil feedstock 9. For example, in some embodiments, the TAN value of the original (unreacted) oil feedstock 9 may be greater than or equal to 1 (such as, for example, 3, 4, 5, etc.) whereas the TAN value of the de-acidified oil feedstock 12 is a lower value, such as less than or equal to 1. As noted above, other acids in the oil feedstock 9 may contribute to the TAN value of the feedstock 9. These acids may also react with the alkali metal in a similar manner, further reducing the TAN value.

This reduction in TAN value may provide a significant financial benefit to the owner of the oil feedstock. As noted above, prices per barrel of oil products that are considered to be high TAN (e.g., with a TAN value greater than 1) are often discounted significantly compared to barrels of oil products that are low TAN. Thus, by reducing the TAN value in the oil feedstock, the value of the oil feedstock may be significantly increased.

Additionally, because the TAN value has been reduced in the de-acidified oil feedstock 12, this liquid feedstock 12 may be used with ferrous material 7, without causing corrosion within the pipes. More specifically, as noted above, having an oil feedstock with a high TAN value can cause corrosion of the stainless steel or other ferrous material used in the piping. However, by reducing the TAN value, through the addition of the alkali metal 5, the de-acidified oil feedstock 12 is less likely to cause corrosion to the ferrous materials 7. For this reason, the corrosion of the ferrous materials 7 is prevented. Thus, one way to prevent the corrosion of the ferrous materials 7 is to reduce the TAN value, preferably to a value that is at or near 0 mgKOH/g. As shown in FIG. 1, by way of example, the ferrous materials 7 may include pipes 7*a*, oil storage tanks 7*b*, refinery equipment 7*c*, oil pipelines 7*d*, etc. Other types of materials that may be the "ferrous materials" 7 include reactors and/or any other material that is used to transport and/or process oil feedstocks.

Figure 2:
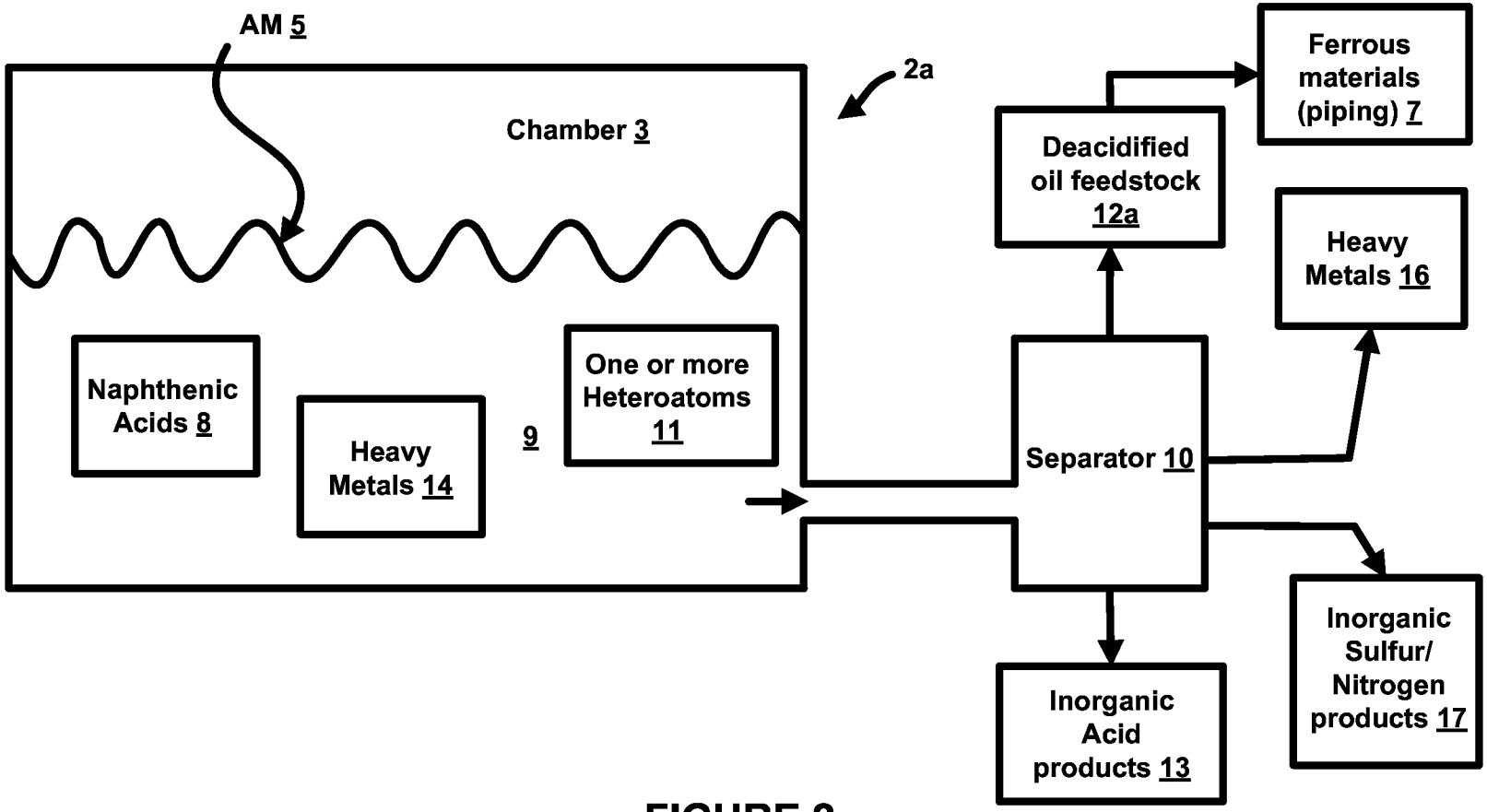
FIG. 2 shows a schematic drawing of a device that may be used to de-acidify a quantity of an oil feedstock.

Referring now to FIG. 2, another embodiment of the device 2*a* is illustrated. As noted above, the device 2*a* is similar to the device 2 shown in FIG. 1. The device 2*a* may be designed to de-acidify the oil feedstock 9. At the same time, the device 2*a* may also be designed to further react the first oil feedstock 9 by removing heavy metals 14 and/or one or more heteroatoms 11 that are present in the oil feedstock 9.

As described above, heavy metals 14 (such as nickel, vanadium, iron, arsenic, etc.) are often found in samples of oil feedstock materials 9. In some embodiments, it may be desirable to remove these heavy metals 14, as such metals can poison catalysts that are typically utilized in hydrocarbon processing. However, as shown in FIG. 2, the device 2*a* may be designed such that the alkali metal 5 may react with the heavy metals 14 in the oil feedstock 9. More specifically, in addition to the alkali metal 5 reacting with the napthenic acids 8 to de-acidify the feedstock (as described above), the quantity of the alkali metal 5 may further react with the heavy metals 14, thereby reducing the heavy metals into their metallic states. This reaction may also occur in the chamber 3.

As shown in FIG. 2, these heavy metals 16 may then be separated and recovered (using the separator 10). It should be noted that the heavy metals 16, in their metallic state, are inorganic materials and thus may separate out from the organic oil feedstock materials. Accordingly, the separator 10 may use this property as a means of separating out the heavy metals 16. Those skilled in the art will appreciate that other separation techniques may also be used to separate out the heavy metals 16. Once the metals 16 have been separated, they may be recovered, sold, used in further processing, etc. As these metals are generally expensive commodities, the fact that such metals may be collected (and used/sold) may provide a significant commercial advantage for the owner of the feedstock.

In addition to removing heavy metals, the alkali metal 5 may also react with one or more heteroatoms 11 (such as N, S) that are present in the oil feedstock 9. These N, S atoms may be bonded as amine groups and/or sulfur groups to the carbon/hydrogen atoms in the organic oil feedstock 9 or may be in cyclic structures such as pyridine, thiophene, and the like. However, as noted herein, the alkali metal 5 may react with these one or more heteroatoms 11 to form inorganic sulfur/nitrogen products 17. For example, if the alkali metal 5 is sodium, then the reaction with the heteroatoms 11 forms inorganic sulfur/nitrogen products 17 such as $Na_2S$, $Na_3N$ and/or other inorganic products. (Again, a separator 10 may be used to separate out the inorganic sulfur/nitrogen products 17 from the oil feedstock). Once the inorganic sulfur/nitrogen products 17 have been removed, the heteroatom to carbon ratio of the resulting oil feedstock is less than the heteroatom to carbon ratio of the original (unreacted) oil feedstock 9.

It should be noted that after the oil feedstock 9 has been de-acidified, demetalized, de-sulfurized and/or de-nitrogenized, then this oil feedstock is referred to as an "de-acidified" oil feedstock 12*a* in that this material is better suited for further refining, commercialization, etc. More significantly, this de-acidified oil feedstock 12*a* has a TAN value that is low, and thus will not be as likely to corrode ferrous materials 7 (such as piping, refinery containers, etc.)

It should be noted that in the embodiment shown in FIG. 2, a single separator 10 is shown as separating out the heavy metals 16, the inorganic acid products 13 and the inorganic sulfur/nitrogen products 17, thereby removing these materials from the oil feedstock 12*a*. However, those skilled in the art will appreciate that multiple separators and/or separation techniques may be used to accomplish such separations. Further, there also may be a sequential separation of the various materials from the oil feedstock 12*a*.

Likewise, it should be noted that in the embodiment of FIG. 2, a single chamber 3 is used to react the oil feedstock 9 with the alkali metal 5 (and thus remove the naphthenic acids 8, heavy metals 14 and heteroatoms 11 from the organic feedstock). Those skilled in the art will appreciate that such reactions could also occur in different chambers. In other words, embodiments may be designed in which a first chamber is used to react the alkali metal 5 with the heavy metals 14 (and the heavy metals 14 are subsequently separated out), a second chamber is used to react the alkali metal 5 with the naphthenic acid 8 (and the acid products 13 are subsequently separated out) and then a third chamber used to react the alkali metal 5 with the heteroatoms 11 (and the sulfur/nitrogen products 17 are subsequently separated out). Of course, if different chambers were used for each of these reactions, the reaction conditions such as pressure, temperature, flow rates, etc., could be adjusted/tailored to optimize each specific reaction.

In the embodiments shown in FIGS. 1 and 2, the alkali metal 5 is shown being added to the chamber 3. Those skilled in the art will appreciate that there are a variety of different ways by which the alkali metal 5 may be added in order to induce a reaction. For example, a sample of the alkali metal 5 may simply be added to the chamber 3. However, many in the oil processing industry are uncomfortable handling metallic sodium (or other metallic alkali metals) because of their reactive nature. Thus, other embodiments may be designed in which the alkali metal 5 is formed in situ within the chamber 3 from alkali metals ions. In other words, alkali metal ions are added to the chamber 3 (which are safe and easy to handle) and then such ions are reduced back to the metallic state via an electrochemical reduction reaction. Once these alkali metal ions have been reduced in situ to form the metallic alkali metal 5, these formed alkali metals 5 immediately react with the oil feedstock 9 (in the manner outlined herein) and are thus consumed almost instantaneously after formation. The embodiments that electrochemically form the alkali metal in situ can be advantageous in that they provide the strong reducing power and reactivity of alkali metal to the oil feedstock without ever having an appreciable amount of the metal present. U.S. patent application Ser. No. 13/679,696 describes various methods for adding the alkali metal to the chamber (including forming the alkali metal in situ from alkali metal ions). Those skilled in the art will appreciate that these types of embodiments may also be implemented in the present application.

Figure 3:
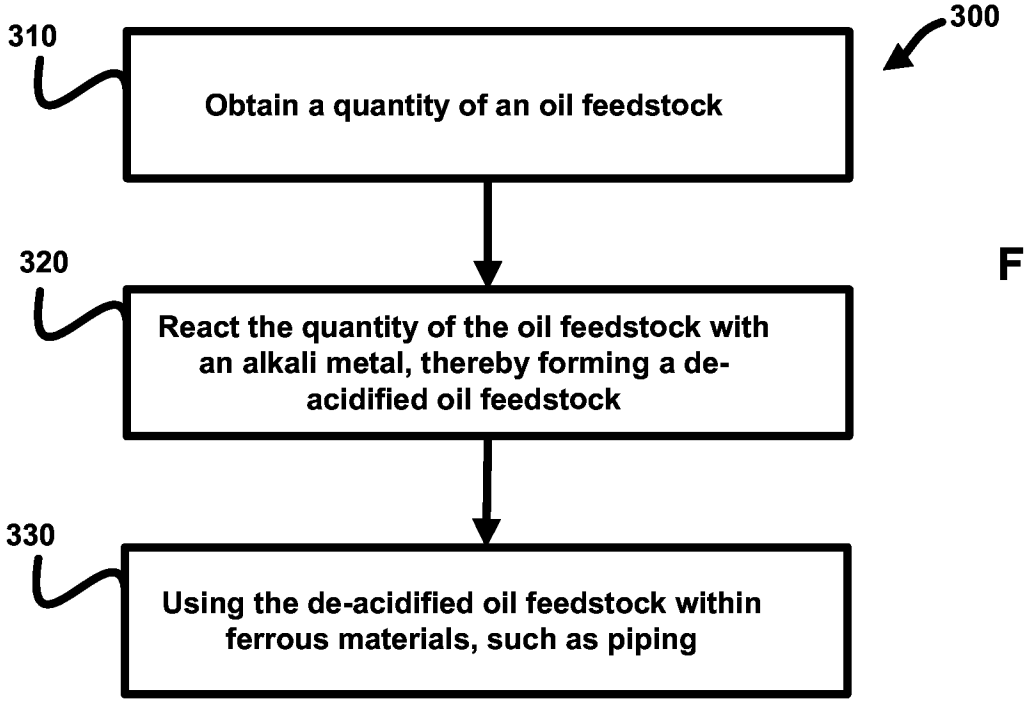
FIG. 3 is a flow diagram of one embodiment of a method of reducing or preventing corrosion of ferrous materials.

Referring now to FIG. 3, a flow diagram is illustrated that shows one embodiment of a method 300 of protecting ferrous materials from corrosion. Specifically, the method involves obtaining 310 a quantity of an oil feedstock material. As noted above, this oil feedstock may comprise bitumen, petroleum, heavy oil, shale oil, oil shale, diesel, coker diesel, naptha, and other hydrocarbon liquids and semi-liquids, and hydrocarbon gases and mixtures thereof. As described herein, the quantity of oil feedstock material may have a TAN value that is "high"—e.g., a TAN value that is greater than or equal to 1 mgKOK/g.

The quantity of oil feedstock may then be reacted 320 with a quantity of an alkali metal (in its metallic state). This alkali metal may be lithium, sodium, potassium and/or alloys thereof. This reaction operates to reduce the TAN value of the oil feedstock to a value, for example, of at or near 0 mgKOK/g. The reduction in the TAN value means that after the reaction, the TAN value of the oil feedstock material will be less than 1 mgKOH/g. (As noted above, the reaction with the alkali metal in its metallic state also operates to remove the heteroatoms found in the oil feedstock material. Accordingly, after reaction with the alkali metal, the heteroatom to carbon ratio of the de-acidified oil feedstock is less than the heteroatom to carbon ratio of the first (unreacted) oil feedstock material. As described in the '874 application, the reaction between the alkali metal and the oil feedstock may occur under pressure of a non-oxidizing gas, such as hydrogen gas, methane, natural gas, shale gas and/or mixtures thereof. In other embodiments, the non-oxidizing gas may comprise nitrogen or an inert gas. Further embodiments may be designed in which the non-oxidizing gas is ethane, propane, butane, pentane, their isomers, ethene, propene, butene, pentene, dienes, and/or mixtures thereof. (Oil retort gas, which is a mixture of gases that is produced in a refinery process may also be used as the non-oxidizing gas.)

Because the TAN value of the de-acidified oil feedstock material has been reduced (preferably to a level that is at or near 0 mgKOH/g), then the de-acidified oil feedstock may be used 330 in conjunction with ferrous materials, such as piping, storage tanks, reactors, etc. that are made of ferrous materials. The fact that the TAN value has been reduced means that the likelihood that the oil feedstock will corrode the ferrous materials is significantly reduced. Thus, when the ferrous materials are used to process and/or transport the de-acidified oil feedstock, the likelihood that the ferrous materials will corrode based upon the acidity of the oil feedstock is reduced. More specifically, oil feedstocks having a high TAN value have been known to corrode the ferrous material used to process and/or transport these materials. However, by reducing the TAN value to nearly zero (e.g., removing the napthenic acids in these materials), the possibility of corrosion on the ferrous materials is reduced.

Figure 4:
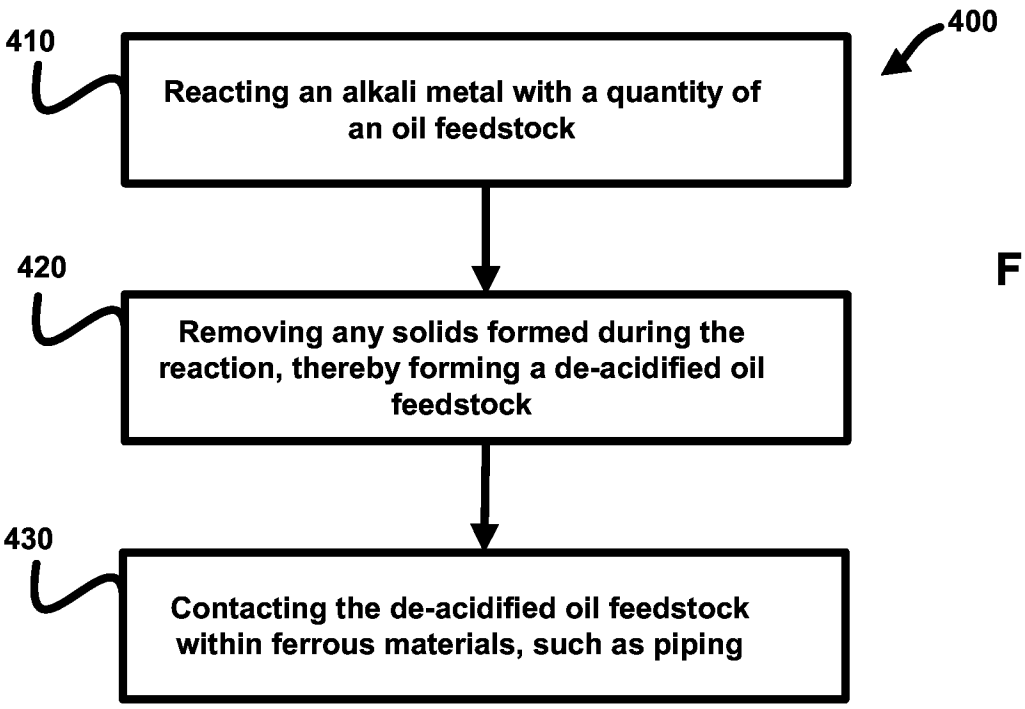
FIG. 4 is a flow diagram of another embodiment of a method of reducing or preventing corrosion of ferrous materials.

Referring now to FIG. 4, another method 400 is disclosed. This method 400 involves reacting 410 an alkali metal with a quantity of an oil feedstock. This reaction with the oil feedstock may involve using a non-oxidizing gas. Any solids that are formed in this reaction may be separated 420 using, for example, a separator. These solids may be salts of napthenic or other acids, sodium sulfide/sodium nitride products formed from heteroatoms, or products formed from heavy metals. Once the solids are separated, the resulting liquid is a de-acidified oil feedstock that has a TAN value of at or near 0 mgKOH/g. This de-acidified oil feedstock may then be contacted 430 with a ferrous material. Because the de-acidified oil feedstock has a low TAN value, this contact with the ferrous material does not corrode the ferrous material.

If excess amounts of the alkali metal were added during the reaction 410, then additional quantities of the alkali metal may be present within the de-acidified oil feedstock. This alkali metal may collect as "droplets" in the oil feedstock. These droplets or particulates present in the oil serve as anodes and provide cathodic protection where the alkali metal oxidizes preferentially to the ferrous metal. This phenomenon is due to the relative electrochemical potentials of alkali metals relative to ferrous substances. For example, the reduction potential for iron is −0.447V but the reduction potential for lithium is −3.04V and for sodium it is −2.71 V. Thus as long as there is free metallic alkali metal flowing with the oil or residing in a storage structure, the alkali metal will oxidize before the ferrous material.

Figure 5:
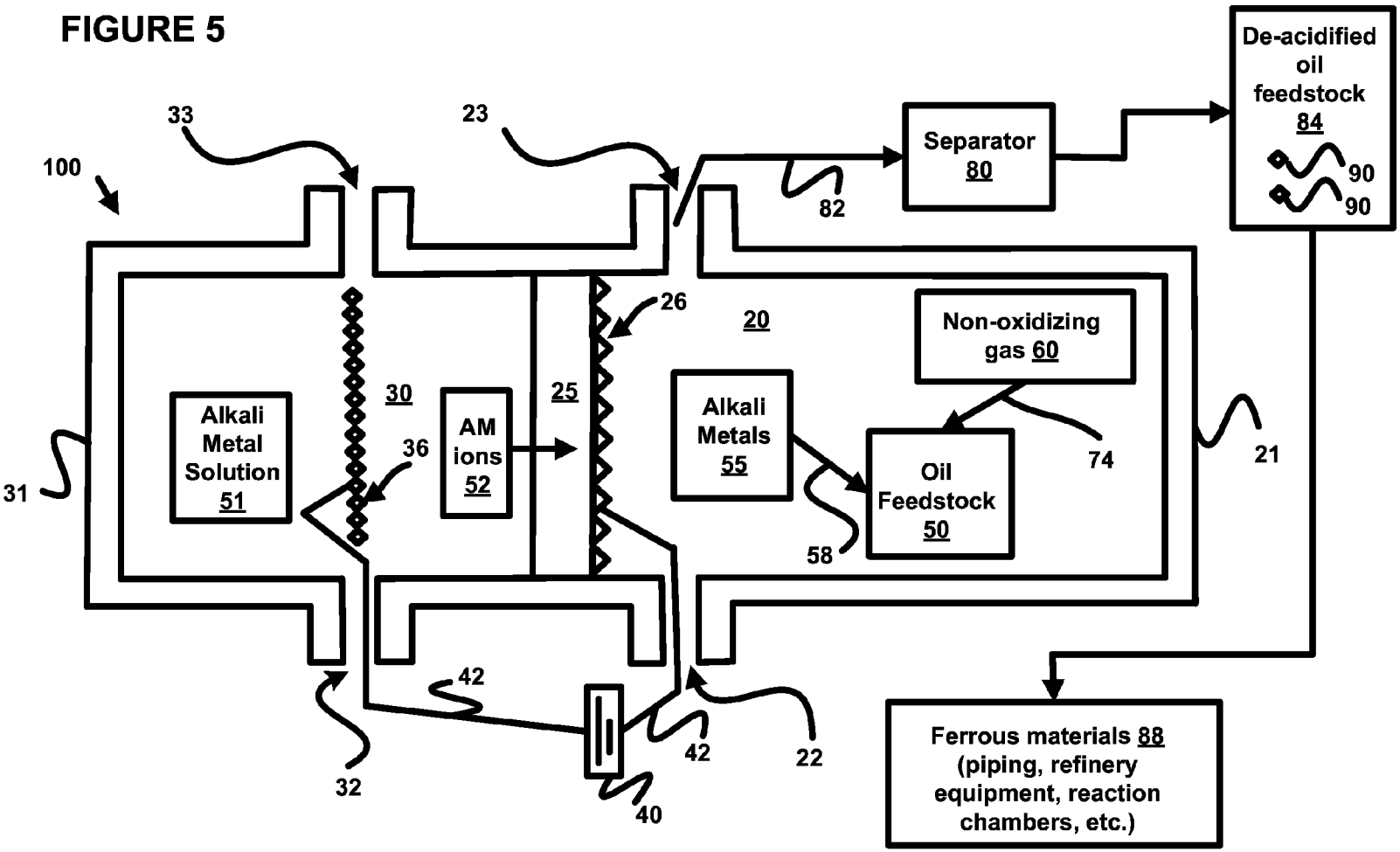
FIG. 5 shows a schematic drawing of a device that may be used to de-acidify a quantity of an oil feedstock.

Referring now to FIG. 5, an embodiment of a device 100 that may be used to de-acidify oil feedstocks, as well as remove the heteroatoms/heavy metals, is illustrated. Specifically, the device 100 consists of at least two chambers, namely a feedstock chamber 20 and an alkali metal source chamber 30. The feedstock chamber 20 has an outer wall 21 and may have an inlet 22 and outlet 23.

The feedstock chamber 20 may be separated from the alkali metal source chamber 30 by an alkali metal ion conductive separator 25. The separator 25 may be comprised of ceramic materials generally known as Nasicon, sodium beta alumina, sodium beta prime alumina or sodium ion conductive glass if the alkali metal is sodium; or Lisicon, lithium beta alumina, lithium beta prime alumina or lithium ion conductive glass if the alkali metal is lithium. The materials used to construct the separator 25 are commercially available from Ceramatec, Inc., of Salt Lake City, Utah.

A cathode 26 which is negatively charged and connected to a power source 40 (via wires 42) may be, at least partially, housed within the feedstock chamber 20. Preferably the cathode 26 may be located in close proximity to the separator 25 to minimize ionic resistance. The cathode 26 may be contacting the separator 25 (as shown in FIG. 5) or screen printed on the separator 25. In other embodiments, the cathode 26 may be integrated with the separator 25 as disclosed in U.S. Patent Publication 2010/0297537 entitled "ELECTROCHEMICAL CELL COMPRISING IONICALLY CONDUCTIVE MEMBRANE AND POROUS MULTIPHASE ELECTRODE" (which patent application is expressly incorporated herein by reference.) By placing the cathode 26 on or near the separator 25, the oil feedstock does not necessarily have to be ionically conducting in order to transfer ions/charges.

The alkali metal source chamber 30 has an outer wall 31 and may have an inlet 32 and outlet 33. An anode 36 (which is positively charged) and connected to the power source 40 (via wires 42) may be, at least partially, housed within the source chamber 30. Suitable materials for the cathode 26 include materials comprising, carbon, graphite, nickel, iron which are electronically conductive. Suitable materials for the anode 36 include materials comprising titanium, platinized titanium, carbon, graphite. In the embodiment shown in FIG. 5, the cathode 26 and the anode 36 are connected to the same power supply 40. Further, FIG. 5 shows the wires 42 exiting the chambers 20, 30 via inlets 22, 32. Such depictions are made for clarity and are not limiting. Those skilled in the art will appreciate how the power source 40/wires 42 may be otherwise arranged in order to connect to the cathode 26 and/or the anode 36.

A mode of operation for the device 100 will now be described. Specifically, a first oil feedstock 50 may enter the feedstock chamber 20 (such as, for example, by flowing through the inlet 22). Concurrently, a dissolved solution of alkali metals 51 will flow through the alkali metal source chamber 30. This solution of alkali metals 51 may be, for example, a solution of sodium sulfide, lithium sulfide, sodium chloride, sodium hydroxide, etc. A voltage is then applied to the anode 36 and cathode 26 from the source 40. This voltage causes chemical reactions to occur. These reactions cause alkali metal ions 52 (abbreviated "AM ions" 52) to pass through the separator 25. In other words, the alkali metal ions 52 flow from the alkali metal source chamber 30, through the separator 25, into the feedstock chamber 20.

Once the alkali metal ions 52 (such as, for example, sodium ions or lithium ions) pass through the separator 25, the ions 52 are reduced to the alkali metal state 55 (e.g., into sodium metal or lithium metal) at the cathode 26. Once formed, the alkali metal 55 intermixes with the first feedstock 50 (as shown by arrow 58). As described herein, the reaction between the oil feedstock 50 and the alkali metal 55 may involve a reaction between the acids (such as naphthenic acid) in the oil feedstock 50. Thus, the reaction with the alkali metal 55, which was formed in situ within the chamber 20, operates to reduce the acid content in the oil feedstock 50, thereby reducing the TAN value of the oil feedstock 50. The TAN value may be reduced to a value that is less than 1 mgKOH/mg.

Additionally and/or alternatively, the reaction between the oil feedstock 50 and the alkali metal 55 formed within the chamber 20 may cause a reaction with the sulfur or nitrogen moieties within the oil feedstock 50. This reaction may also reduce heavy metals, such as vanadium and nickel in the feedstock 50. Further, as explained in the '874 application, at an elevated temperature and elevated pressure, the reaction between alkali metals 55 and the heteroatoms (S, N) forces the sulfur and nitrogen heteroatoms to be reduced by the alkali metals into ionic salts (such as $Na_2S$, $Na_3N$, $Li_2S$, etc.). These ionic salts may then be removed from the oil feedstock 50. As such, the content of sulfur and nitrogen within the oil feedstock 50 may be significantly reduced by the reaction of the alkali metal 55 formed within the chamber 20. In other words, the heteroatom-to-carbon ratio of the resulting oil feedstock 84 may be less than the heteroatom-to-carbon ratio of the original (unreacted) oil feedstock 50. Also, the amount of heavy metals in the feedstock may further be reduced. Thus, the ratio of carbon to heavy metals in the reacted feedstock 84 is less than the ratio of carbon to heavy metals in the original (unreacted) feedstock 50.

Further, in addition to the oil feedstock 50, the chamber 20 may also include a quantity of a non-oxidizing gas 60 that reacts with the oil feedstock 50 (as shown by arrow 74). Specifically, as taught by the '874 application, when the sulfur/nitrogen moieties of the oil feedstock 50 react with the alkali metals 55, radical species are formed that may react with the non-oxidizing gas 60. In some embodiments, the non-oxidizing gas 60 may be hydrogen gas, including the hydrogen gas formed by the reaction with naphthenic acid. (It should be noted that if hydrogen is used as the gas 60, the amount of hydrogen needed is less than the amount of hydrogen that would be required if a Steam-Methane Reforming Process were used to form the hydrogen). In other embodiments, the non-oxidizing gas 60 comprises natural gas, shale gas and/or mixtures thereof, methane, ethane, propane, butane, pentane, their isomers, ethene, propene, butene, pentene, dienes, and/or mixtures thereof. As explained in the '874 application, this reaction with the non-oxidizing gas 60 may operate to produce an hydrocarbon that has a greater hydrogen-to-carbon ratio than the original oil feedstock. The oil feedstock produced in the reaction may also have a greater energy value than the original oil feedstock. Typically the presence of non-oxidizing gas 60 may result in a reduction of formation of insoluble solids during the reaction. It is believed that these solids are large organic polymers that are formed as part of the radical reactions. However, by using the non-oxidizing gas 60, this gas 60 acts as a "capping" species that prevents the formation of these solid, organic polymers. Thus, by using the non-oxidizing gas 60, the subsequent yield of the liquid oil feedstock (e.g., the desired product) may be increased.

The reactions described in FIG. 5 may be conducted at elevated temperatures. For example, the reactions may occur at temperatures above the melting temperature of sodium or at higher temperatures found effective for the particular feedstock. The mode of operation of the device 100 may further consist of using molten sodium as the sodium source 51 in the alkali metal source chamber 30 or lithium metal as the lithium source. The reactions may further be conducted at elevated pressure, for example in the 300-2000 pounds per square inch range.

In some embodiments, the oil feedstock 50 may be passed through the device 100 (as the solution of sodium sulfide also passed through). Once passed through the device 100, the oil feedstock may flow into another vessel operated at a different temperature and pressure (e.g., temperatures and pressures more conducive to the reactions desired and where the residence time of the feedstock in the second vessel size is matched to the reaction kinetics and flow rates).

As described herein, various solids, inorganic compounds, etc., may be formed when performing the reactions outlined herein. These inorganic products may comprise $Na_2S$, $NaN_3$, heavy metals and solid organic polymers that are formed by the radical reactions. In order to deal with these inorganic compounds, the process used in conjunction with the device of FIG. 5 may further involve filtering, or separating by centrifugal forces the feedstock after it has been exposed to the sodium for sufficient time to remove solids from the liquids. This separation may involve the use of a separator 80, as described below.

The oil feedstock 50, alkali metal solution 51 and other components of the device 100 may be dissolved in a polar solvent such as Formamide, Methyl formamide, Dimethyl formamide, Acetamide, Methyl acetamide, Dimethyl acetamide, Triethylamine, Diethyl acetamide, Ethylene glycol, Diethylene glycol, Triethylene glycol, Tetraethylene glycol, Ethylene Carbonate, Propylene Carbonate, Butylene Carbonate, Cyclohexanol, 1,3-Cyclohexanediol, 1,2 Ethanediol, 1,2-Propanediol, Ethanolamine, Methyl sulfoxide, Dimethyl sulfoxide, Tetramethylene sulfoxide, Sulfolane, Gamma-butyrolactone, Nitrobenzene, Acetonitrile, Pyridine, quinoline, ammonia, ionic liquids or molten fused salts. For example, the alkali metal solution 51 may be dissolved in one or more of these solvents and then be allowed to flow into the alkali metal source chamber 30. (The salts that are used for the alkali metal solution 51 may be alkali metal chlorides, hydroxides, phosphates, carbonates, sulfides and the like.) Similarly, such solvents may be used with the oil feedstock 50 and/or the gas 60 and then the mixture may be allowed to flow into the chamber 20.

Depending on the alkali metal source (e.g., the alkali metal solution 51), the anode reaction in the alkali metal source chamber 30 may vary. For example sulfides may form polysulfides and or elemental sulfur, chlorides may form chlorine gas, hydroxides may form oxygen gas, carbonates may form oxygen gas and evolve carbon dioxide and the like. If the alkali metal source is an alkali metal, metal ions will simply form. These variations constitute different embodiments. Gas handling and recovery may be a part of the overall process.

As shown in FIG. 5, the products formed in the oil feedstock chamber 20 may be sent to a separator 80 (as shown by arrow 82). In this separator 80, the inorganic products may form a phase that is separable from an organic phase that comprises the reacted oil feedstock and/or unreacted oil feedstock. To facilitate this separation, a flux may be added to the separator. (Those skilled in the art are familiar with the materials that may be used as the flux that will facilitate separation between the organic feedstock materials and the inorganic products.) After separation, the alkali metal from the inorganic products may be regenerated and reused. In some embodiments, the separator 80 may be a settling chamber or other similar structure.

As shown by FIG. 5, after leaving the separator 80, the output may be referred to as the de-acidified oil feedstock 84. As shown in FIG. 5, this de-acidified oil feedstock 84 is designed such that it may be used with ferrous materials 88 without causing corrosion. These ferrous materials 88 may comprise piping, storage tanks, pipes, refinery equipment, reaction chambers, oil and gas processing equipment, etc. The de-acidified oil feedstock 84 does not cause corrosion because of its low TAN values, as explained herein.

Further, the de-acidified oil feedstock 84 may comprise a quantity of alkali metal 90 that coagulates together to form droplets, etc. These droplets present in the oil feedstock 84 serve as anodes and provide cathodic protection where the alkali metal oxidizes preferentially to the ferrous metal. This phenomenon is due to the relative electrochemical potentials of alkali metals relative to ferrous substances. For example, the reduction potential for iron is −0.447V but the reduction potential for lithium is −3.04V and for sodium it is −2.71 V. Thus as long as there is free metallic alkali metal flowing with the oil feedstock (through the pipes) or residing in a storage structure and/or ferrous materials 88, the alkali metal will oxidize before the ferrous material 88, thereby providing further protection to the ferrous materials 88. In other words, droplets 90 may be within the ferrous materials 88 as a means of further preventing corrosion of the ferrous materials 88.

All the journal articles, patent applications and patents listed herein are expressly incorporated herein by reference.

What is claimed is:

1. A method comprising:

electrochemically producing an alkali metal in its metallic state, reacting an oil feedstock comprising naphthenic acids with the alkali metal in its metallic state to form a de-acidified oil feedstock, and processing and/or transporting the de-acidified oil feedstock in a ferrous material, wherein the oil feedstock has a TAN value greater than or equal to 1 mg KOH/g, and the de-acidified oil feedstock has a TAN value that is at or near 0 mg KOH/g.

2. The method of claim 1, wherein the alkali metal in its metallic state comprises lithium, sodium, potassium and/or alloys thereof.

3. The method of claim 1, wherein the de-acidified oil feedstock comprises a quantity of the alkali metal in its metallic state.

4. The method of claim 1, wherein the oil feedstock comprises heteroatoms/heavy metals, and the alkali metal further reacts with the heteroatoms/heavy metals such that a heteroatom to carbon ratio of the de-acidified oil feedstock is less than a heteroatom to carbon ratio of the oil feedstock.

5. The method of claim 4, wherein the reaction of the alkali metal occurs in the presence of a non-oxidizing gas.

6. A method comprising:

reacting an alkali metal in its metallic state with an oil feedstock in the presence of a non-oxidizing gas comprising hydrogen and/or hydrocarbon gases, wherein the oil feedstock comprises naphthenic acids and the oil feedstock has a TAN value of greater than or equal to 1 mg KOH/g;

removing solids formed from the reaction to provide a liquid de-acidified oil feedstock, and contacting the de-acidified oil feedstock liquid with a ferrous material, wherein the liquid de-acidified oil feedstock has a TAN value that is at or near 0 mg KOH/g;

and wherein the alkali metal in its metallic state is formed by electrochemically reducing alkali metal ions.

7. The method of claim 6 wherein the non-oxidizing gas comprises hydrogen, methane, natural gas, shale gas, and/or mixtures thereof.

8. The method of claim 6 wherein the non-oxidizing gas comprises methane, ethane, propane, butane, pentane, isomers of the foregoing, ethene, propene, butene, pentene, dienes, and/or mixtures thereof.

* * * * *